US012798737B2

(12) United States Patent
White et al.

(10) Patent No.: US 12,798,737 B2
(45) Date of Patent: Nov. 17, 2026

(54) DRYSUIT WITH STRETCH AND COMPRESSION PANELS

(71) Applicant: Whites Cold Water Drywear Ltd., Saanichton (CA)

(72) Inventors: Frank Ellison White, Saanichton (CA); James Griffiths, Victoria (CA)

(73) Assignee: Whites Cold Water Drywear Ltd., Saanichton (CA)

( * ) Notice: Subject to any disclaimer, the term of this patent is extended or adjusted under 35 U.S.C. 154(b) by 0 days.

(21) Appl. No.: 18/827,541

(22) Filed: Sep. 6, 2024

(65) Prior Publication Data

US 2026/0070637 A1 Mar. 12, 2026

(51) Int. Cl.
*B63C 11/04* (2006.01)
*B63C 11/00* (2006.01)

(52) U.S. Cl.
CPC ..... *B63C 11/04* (2013.01); *B63C 2011/043* (2013.01)

(58) Field of Classification Search
CPC ..... B63C 11/04; B63C 2011/043
See application file for complete search history.

(56) References Cited

U.S. PATENT DOCUMENTS 1,844,888 A * 2/1932 Lorenz ..... A41D 7/00 450/31
2,032,216 A * 2/1936 Kispert ..... A41C 1/06 450/19
2,280,479 A * 4/1942 Coben ..... A41D 27/10 2/93
2,501,899 A * 3/1950 Herbener ..... A41C 1/14 D2/702
2,526,813 A * 10/1950 Fanning ..... A41F 9/02 2/237
2,554,380 A * 5/1951 Olrich ..... A41D 27/10 D2/858
2,651,040 A * 9/1953 Block ..... A41D 7/00 D2/731
2,745,103 A * 5/1956 Van ..... A41C 1/00 D2/702
2,752,599 A * 7/1956 Laguzzi ..... A41C 1/003 450/151

(Continued)

FOREIGN PATENT DOCUMENTS

GB 2266837 A 11/1993

*Primary Examiner* — Robert H Muromoto, Jr.
(74) *Attorney, Agent, or Firm* — Nexus Law Group LLP; Nicholas Toth; Otto Zsigmond

(57) ABSTRACT

A drysuit includes: a body suit formed of water impermeable material having a front portion, a back portion, a first side portion, a second side portion, a head opening, and an entry opening; one or more seals connected to the head opening and the entry; fastener connected to the entry opening; and one or more elongated panels of elastic material connected to and overlaying the first side portion, the second side portion, the front portion, or the back portion in a longitudinal direction for providing stretch to and compression to the body suit in a transverse direction; wherein the one or more panels of elastic material are smaller in area than the first side portion, the second side portion, the front portion, or the back portion. The drysuit provides stretch and compression at critical points of the drysuit for increased safety, fit, durability and adaptability to/for the user.

3 Claims, 13 Drawing Sheets

(56) References Cited

U.S. PATENT DOCUMENTS 3,037,210 A * 6/1962 Neuman ..... A41D 27/10 D2/858
3,086,214 A * 4/1963 Seymour ..... A41D 13/02 D2/743
3,654,632 A * 4/1972 Lacroix ..... A41D 1/00 2/125
4,293,957 A * 10/1981 Melarvie ..... A41D 13/012 2/275
4,483,019 A * 11/1984 Spangrud ..... B63C 11/04 2/82
4,492,227 A * 1/1985 Senn ..... A61F 13/061 602/26
4,538,615 A * 9/1985 Pundyk ..... A41C 1/003 450/131
4,938,753 A * 7/1990 Van Gompel ..... A61F 13/496 604/385.29
4,940,464 A * 7/1990 Van Gompel ..... A61F 13/15593 604/385.22
4,946,453 A * 8/1990 Monson ..... A41D 31/18 604/312
5,091,992 A * 3/1992 Pusic ..... A42B 3/0486 2/466
5,109,546 A * 5/1992 Dicker ..... A41D 13/0015 482/121
5,201,074 A * 4/1993 Dicker ..... A41D 13/0015 482/121
5,768,703 A * 6/1998 Machado ..... B63C 11/04 2/2.15
5,898,934 A * 5/1999 Hunter ..... B63C 11/04 2/2.15
6,231,488 B1 * 5/2001 Dicker ..... A63B 21/0004 482/121
6,478,785 B1 * 11/2002 Ashton ..... A61F 13/49011 604/385.24
6,585,713 B1 * 7/2003 LeMahieu ..... A61F 13/49011 604/391
6,715,149 B2 * 4/2004 Myerscough ..... A41D 13/012 2/82
7,631,363 B2 * 12/2009 Myerscough ..... B63C 11/04 2/2.15
7,937,771 B2 * 5/2011 Mazzarolo ..... A41D 31/185 2/456
7,941,871 B1 * 5/2011 Jorgensen ..... A41D 7/005 2/238
8,191,170 B2 * 6/2012 Ehlme ..... B32B 27/12 2/2.15
8,561,212 B2 * 10/2013 Saotome ..... B63C 11/04 2/2.15
9,393,144 B2 * 7/2016 Ingimundarson ..... A61F 5/30
10,093,401 B2 * 10/2018 Myerscough ..... A41D 13/012
10,413,005 B2 * 9/2019 Arnold ..... A41D 31/185
10,765,156 B2 * 9/2020 Myerscough ..... A41B 9/00
11,786,000 B2 * 10/2023 Hussey ..... A41D 3/00 2/82
12,225,952 B2 * 2/2025 Morgan ..... A41D 13/012
2001/0025383 A1 * 10/2001 Thompson ..... A41D 13/02 2/234
2002/0111596 A1 * 8/2002 Fletcher ..... A61F 13/505 604/385.03
2003/0114810 A1 * 6/2003 Weber ..... A61F 13/496 604/362
2003/0115653 A1 * 6/2003 Myerscough ..... A41D 13/012 2/2.15
2005/0071905 A1 * 4/2005 Polak ..... A41D 31/065 2/2.16
2007/0049141 A1 * 3/2007 Staver ..... A41D 7/001 441/115
2007/0186326 A1 * 8/2007 Myerscough ..... A41D 13/02 2/69
2007/0271671 A1 * 11/2007 Okajima ..... A41D 1/04 2/69
2010/0076394 A1 * 3/2010 Hayase ..... A61F 13/49019 604/385.29
2011/0283442 A1 * 11/2011 Jorgenson ..... A41D 7/005 2/227
2014/0338089 A1 * 11/2014 Brooks ..... A41D 13/012 2/2.15
2016/0040325 A1 * 2/2016 Hussey ..... A41D 27/24 28/169
2016/0095367 A1 * 4/2016 Curran ..... A41D 27/285 2/243.1
2017/0265531 A1 * 9/2017 Toussaint ..... A41D 7/00
2017/0290382 A1 * 10/2017 Arnold ..... A41D 13/0015
2018/0116304 A1 * 5/2018 Decker ..... A41D 13/00
2018/0168892 A1 * 6/2018 Lavon ..... A61F 13/49061
2019/0053580 A1 * 2/2019 Tarnow ..... A43C 19/00
2019/0364989 A1 * 12/2019 Mazzarolo ..... A41D 13/02
2021/0007421 A1 * 1/2021 Morgan ..... B29C 66/1122
2023/0000181 A1 * 1/2023 Halsted ..... A41D 13/012

* cited by examiner

DRYSUIT WITH STRETCH AND COMPRESSION PANELS

BACKGROUND OF THE INVENTION

1. Field of Invention

This invention relates to a novel design of a drysuit and, in particular, to a drysuit with longitudinally oriented stretch and compression panels for use in or around water activities.

2. Description of Related Art

Conventional drysuits have traditionally been made from non-stretch fabric to provide a waterproofing (i.e., water impermeable) feature. Use of non-stretch fabrics means that the amount of fabric used will be much greater than the area required to cover the body of a user to accommodate for different body sizes and shapes in a standard, ready-made, conventional drysuit. Such traditionally made drysuits capture a high volume of air between the user and the drysuit when the drysuit is worn by a user. For example, someone with a small waist and big hips cannot get into a conventional drysuit without the waist section of the drysuit being as wide as the hip section of the drysuit. To accommodate for such a body shape, the conventional drysuit design must be in the shape of a tube. A tube-shaped drysuit would inherently capture a higher volume of excess air upon donning the suit (compared to, for example, an hourglass-shaped drysuit, which would typically be more fitted to a female body shape and therefore capture less airspace between the suit and the user).

Beyond the shape of the drysuit, because excess fabric is generally used in conventional, ready-made drysuits to accommodate for a range of body sizes (even within a subset of sizes, e.g., small, medium, large), when the drysuit is worn by a user there will be a much larger volume of air captured between the drysuit and the user for users that are smaller within a size subset. Such excess volumes of air will expand on accent, possibly causing rapid accent injury or death. Excess air in the drysuit can also cause buoyancy issues when ascending. For example, the volume of air will double from 33 feet below sea level to surface (sea level). Further, with the excess fabric in a loose-fitting conventional drysuit, the captured air within the drysuit could expand and migrate to the extremities, including the feet, which could cause the user to flip and complete a feet-first accent, causing injury or death. Lastly, the accumulation of excess fabric at critical points can also create a safety hazard because the excess fabric can interfere with equipment used by the user.

Examples of some prior art drysuits are described in U.S. Pat. No. 7,631,363 to Myerscough (the "'363 Patent"), U.K. Patent App. No. GB9309694.9 to Hutchins (the "'694 Patent"), U.S. Pat. No. 10,093,401 to Myerscough (the "'401 Patent"), and U.S. Pat. No. 6,715,149 to Myerscough (the "'149 Patent").

The '363 Patent provides a dual layer drysuit having a full body, elastic, water permeable outer layer overlaying a full body, inelastic, water impermeable inner layer, wherein the outer layer functions to reduce the volume of air trapped between the drysuit and the user when worn by a user. However, due to the all-over dual layer nature of the drysuit provided in the '363 Patent, said drysuit requires use of a lightweight inner layer that may be prone to breakage, and said drysuit cannot accommodate for varying positionings of an entry opening and body zipper to allow for ease of entry into and exit out of said drysuit.

The '694 Patent provides for a drysuit with a constriction means utilizing elongated bands of elastic material running along the front side of the chest, along and across the waistline, and at the knee section of the drysuit. While said elongated bands may function to compress various sections of the drysuit to reduce the volume of air trapped between the drysuit and the user when worn by a user, said elongated bands fail to allow for adequate stretch and expansion of the drysuit such that a user (of varying body sizes and shapes) may easily enter and exit the drysuit while maintaining a significant general reduction of the volume of air trapped between the drysuit and user when worn by the user.

The '401 Patent provides for a drysuit having two compression flaps over the torso section of the drysuit. While said compression flaps may function to compress the torso section of the drysuit to reduce the volume of air trapped between the drysuit and the user when worn by a user, said compression flaps fail to allow for adequate stretch and expansion of the drysuit in various key areas such that a user (of varying body sizes and shapes) may easily enter and exit the drysuit while maintaining a significant general reduction of the volume of air trapped between the drysuit and user when worn by the user.

The '149 Patent provides for a drysuit having elastic overlay panels above or below the knee section and at the lower back section of the drysuit. While said overlay panels may function to compress certain sections of the drysuit to reduce the volume of air trapped between the drysuit and the user when worn by a user, said overlay panels fail to allow for adequate stretch and expansion of the drysuit in various key areas such that a user (of varying body sizes and shapes) may easily enter and exit the drysuit while maintaining a significant general reduction of the volume of air trapped between the drysuit and user when worn by the user.

An object of the invention is to address the above shortcomings.

SUMMARY

The above shortcomings may be addressed by providing, in accordance with one aspect of the invention, an apparatus for a drysuit with stretch and compression panels for use in or around water. The drysuit includes: a body suit formed of water impermeable material, the body suit having a front portion, a back portion opposite the front portion, a first side portion disposed between the front portion and the back portion, a second side portion disposed between the front portion and the back portion, the second side portion being opposite the first side portion, a head opening, and an entry opening; one or more seals connected to the head opening and the entry opening for sealing the body suit against entry of water; a fastener connected to the entry opening for fastening the entry opening together; and one or more elongated panels of elastic material connected to the first side portion, the second side portion, the front portion, or the back portion in a longitudinal direction relative to the body suit, for providing stretch to and compression of the body suit in a transverse direction opposite the longitudinal direction; wherein the one or more panels of elastic material are smaller in area than the first side portion, the second side portion, the front portion, or the back portion the one or more panels of elastic material are connected to.

The drysuit may include the one or more panels of elastic material being connected to the first side portion and the second side portion. The drysuit may include the one or more panels of elastic material being connected to the front portion and the back portion.

The foregoing summary is illustrative only and is not intended to be in any way limiting. Other aspects and features of the present invention will become apparent to those of ordinary skill in the art upon review of the following description of embodiments of the invention in conjunction with the accompanying figures and claims.

BRIEF DESCRIPTION OF THE DRAWINGS

In drawings which illustrate by way of example only embodiments of the invention.

DETAILED DESCRIPTION

Figure 1A:
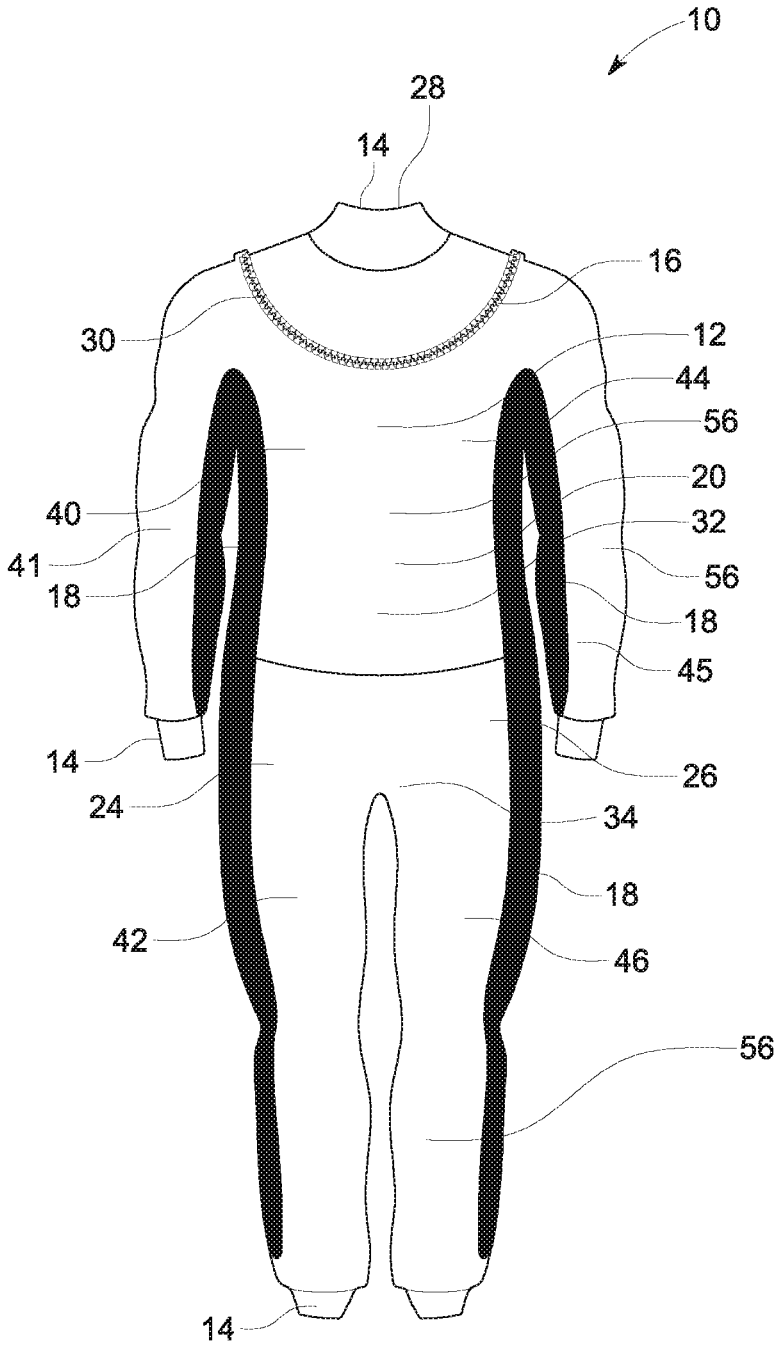
FIG. 1A is a front view of a drysuit according to an embodiment of the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention as defined by the claims.

Referring to FIGS. 1 to 8, the drysuit according to an embodiment of the invention is shown generally at 10. Drysuit 10 is for use in or around water to keep a user dry. Drysuit 10 includes a body suit 12, one or more seals 14, a fastener 16, and one or more elongated panels of elastic material 18.

Referring to FIGS. 1 to 8, body suit 12 is generally formed in the shape of a human figure and generally covers the full body of a user 100, when worn by user 100. Body suit 12 is a single layer body suit formed of a water impermeable material. Examples of a water impermeable material that may be used to form body suit 12 include, but is not limited to, nylon, nylon laminated with polyurethane, rubber, polyester, or any other suitable material that is water impermeable.

Referring to FIGS. 1 to 8, body suit 12 has a front portion 20, a back portion 22 opposite front portion 20, a first side portion 24 disposed between front portion 20 and back portion 22, a second side portion 26 disposed between front portion 20 and back portion 22, second side portion 26 being opposite first side portion 24, a head opening 28, and an entry opening 30.

Referring to FIGS. 1A, 2, 3A, 4A to 4C, and 6 to 8, front portion 20 extends along the front and a length of body suit 12. Front portion 20 includes a front torso section 32 and a front leg section 34 opposite from and continuous to front torso section 32. Front torso section 32 extends along the upper half of front portion 20. Front leg section 34 extends along the lower half of front portion 20.

Figure 1B:
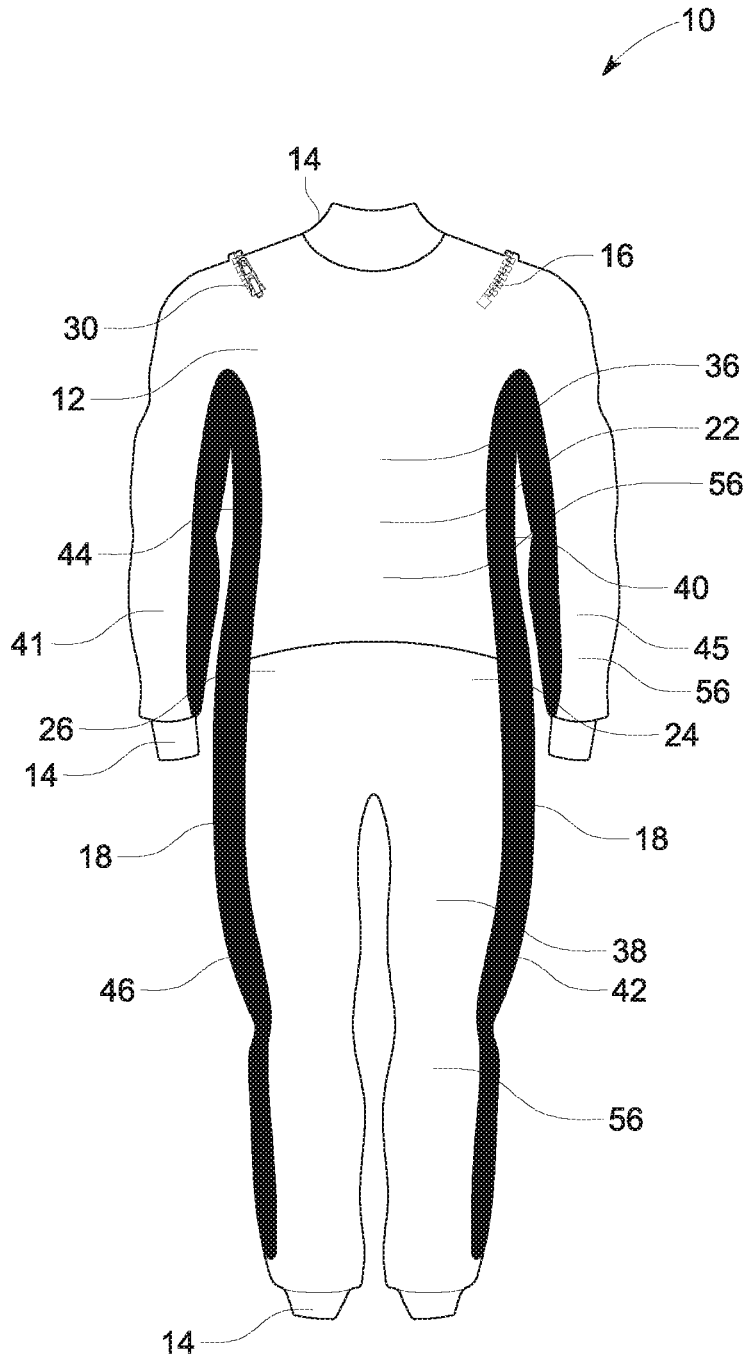
FIG. 1B is a back view of the drysuit of FIG. 1A.
Figure 3A:
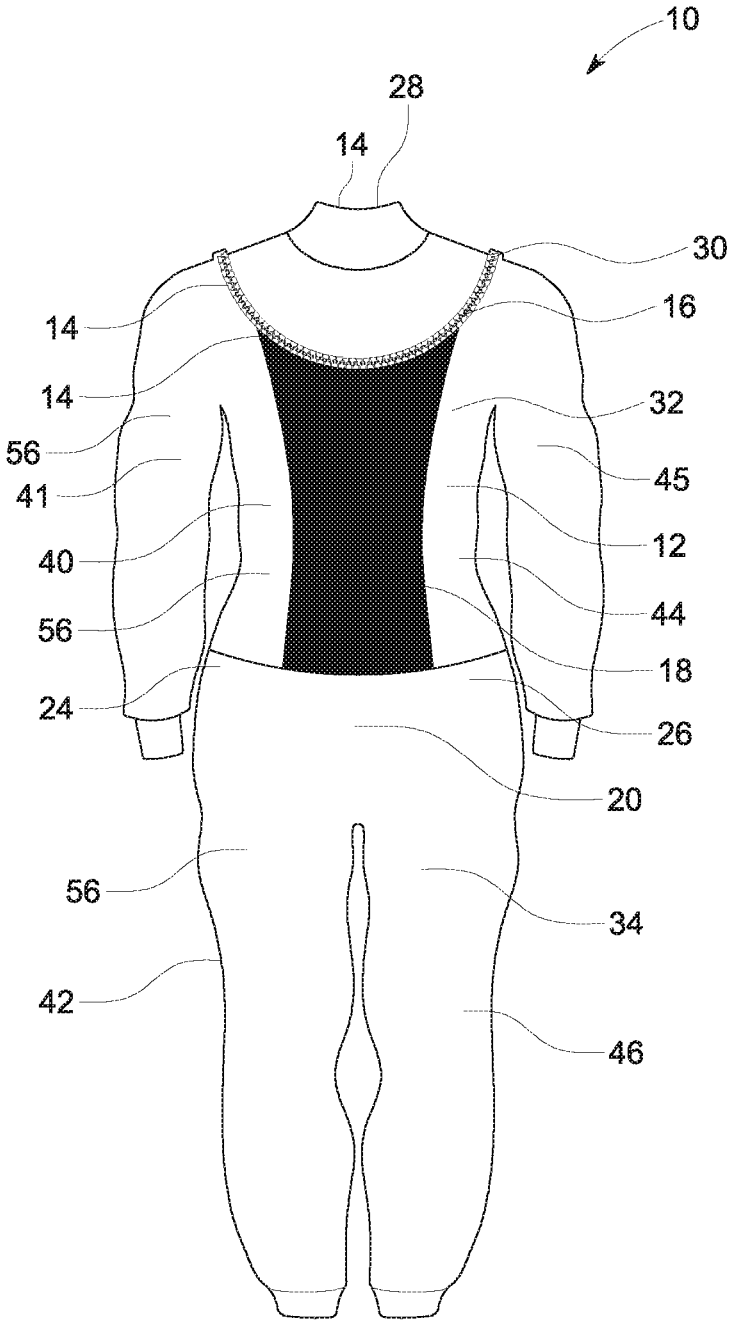
FIG. 3A is a front view of a drysuit according to another embodiment of the present invention.
Figure 3B:
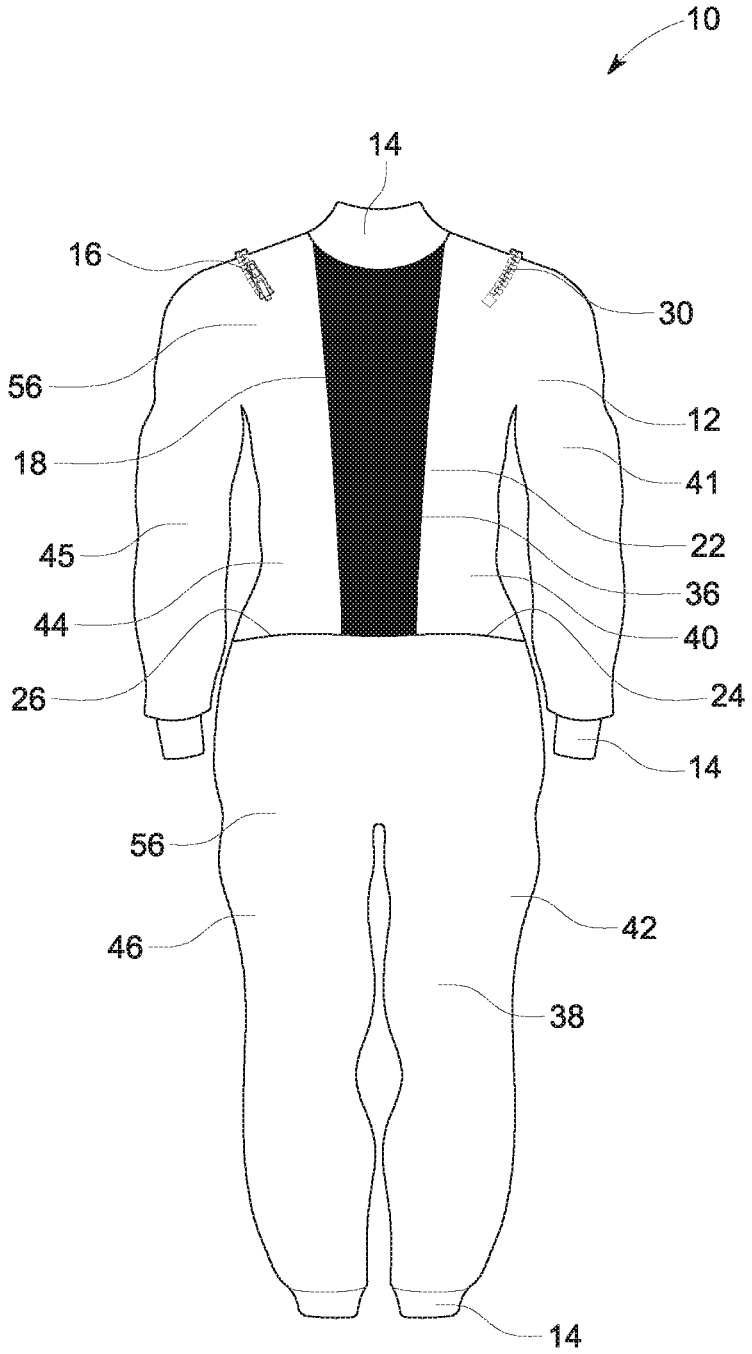
FIG. 3B is a back view of the drysuit of FIG. 3A.

Referring to FIGS. 1B and 3B, back portion 22 extends along the back and a length of body suit 12. Back portion 22 includes a back torso section 36 and a back leg section 38 opposite from and continuous to back torso section 36. Back torso section 36 extends along the upper half of back portion 22. Back leg section 38 extends along the lower half of back portion 22.

Referring to FIGS. 1 to 8, first side portion 24 extends along a side and length of body suit 12. First side portion 24 includes a first side torso section 40 and a first side leg section 42 opposite from and continuous to first side torso section 40. First side torso section 40 extends along the upper half of first side portion 24. First side leg section 42 extends along the lower half of first side portion 24. First side portion 24 may also extend along an arm of body suit 12 and may include a first side arm section 41.

Referring to FIGS. 1 to 4 and FIGS. 6 to 8, second side portion 26 extends along a side and length of body suit 12. Second side portion 26 includes a second side torso section 44 and a second side leg section 46 opposite from and continuous to second side torso section 44. Second side torso section 44 extends along the upper half of second side portion 26. Second side leg section 46 extends along the lower half of second side portion 26. Second side portion 26 may also extend along an arm of body suit 12 and may include a second side arm section 45.

Although body suit 12 is described as having various portions and sections (e.g., front portion 29, back portion 22, back torso section 36, first side arm section 41, second side leg section 46, etc.), it will be understood by a person skilled in the art that body suit 12 may be formed of a uniform construction (i.e., constituting of one single, continuous piece of material) or of contiguous pieces joined together to form a water impermeable body suit 12. The various portions and sections as described are generally for reference to different areas of body suit 12 and is not necessarily meant to delineate separate pieces or individual segments of body suit 12. Further, body suit 12 and the various portions and sections of body suit 12 as described are not limited to only the portions and sections as described. For example, referring to FIG. 8, body suit 12 may also include a foot portion 48 that wraps around a user's feet to form an integrated bootie, a hand portion 50 that wraps around a user's hand to form an integrated glove, a hood portion 52 that wraps around a user's head to form an integrated hood, etc. Body suit 12 generally covers most, if not all, of a user's body when worn but may or may not include the hands, feet, and head. It will be understood by a person skilled in the art that body suit 12 may include any number of portions and sections to cover a user's full body.

Figure 7:
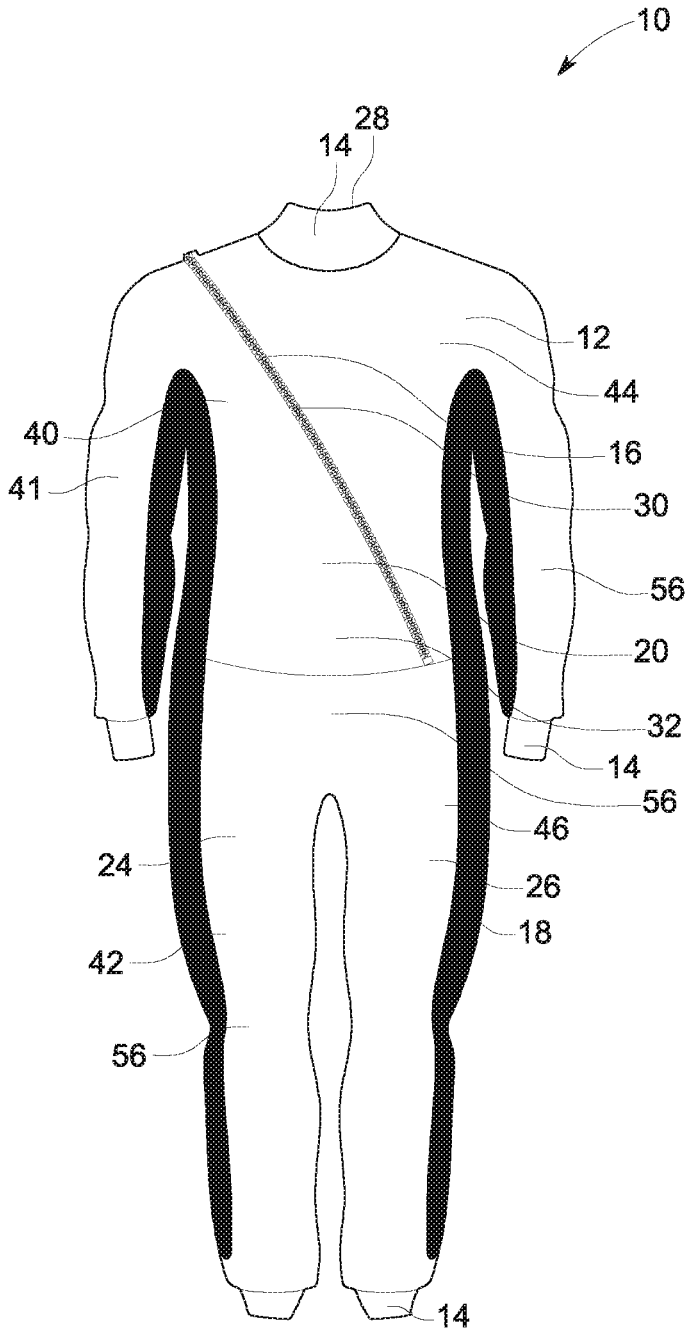
FIG. 7 is a front view of a drysuit according to another embodiment of the present invention.
Figure 8:
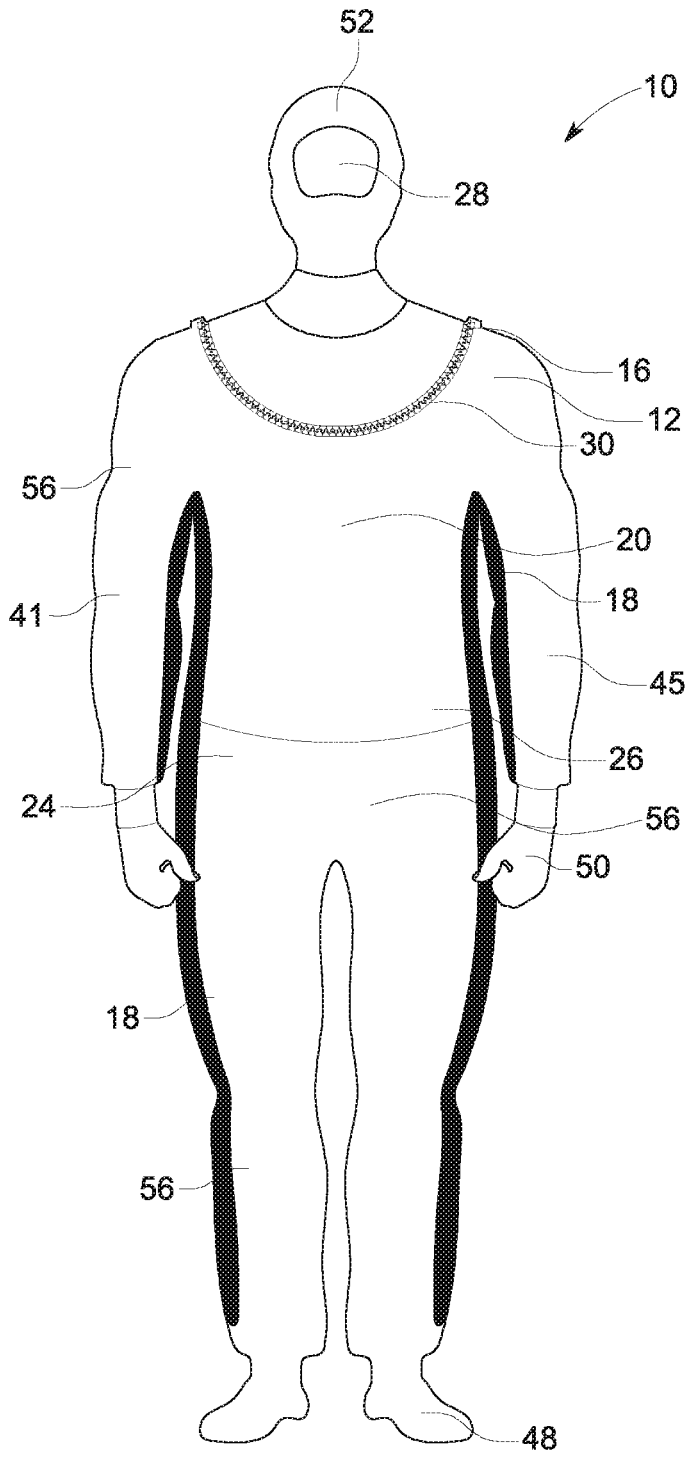
FIG. 8 is a front view of a drysuit according to another embodiment of the present invention.
Figure 9:
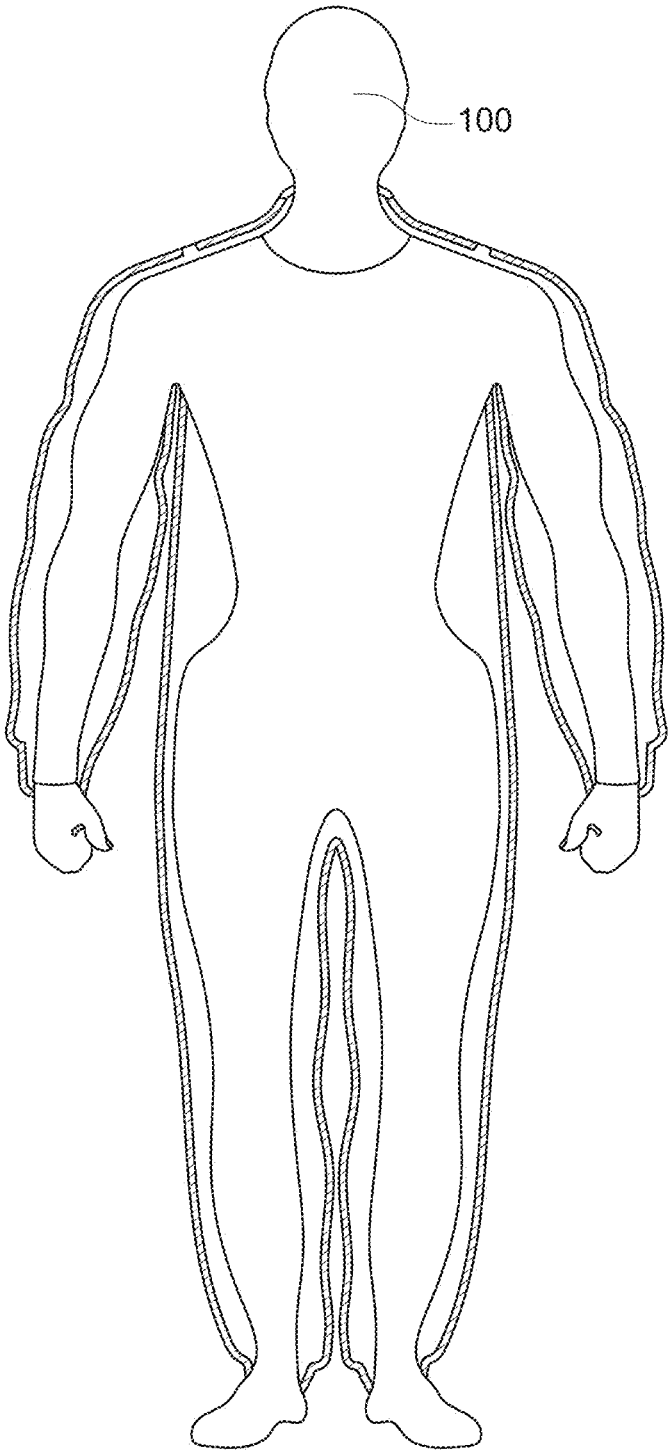
FIG. 9 (PRIOR ART)
FIG. 9 is a cross section view of a conventional drysuit of the PRIOR ART, showing the general air space between the water impermeable layer of the conventional drysuit of the PRIOR ART and a user's body.

Referring to FIGS. 1 to 4 and FIGS. 6 to 8, head opening 28 is an opening in the suit to allow a user's head to go through and/or to allow a user's face to be exposed. Head opening 28 may include a hood (as illustrated in FIG. 8) or other extensions that go beyond the neck of a user. Accordingly, head opening 28 may wrap around a user's neck, face, or otherwise. As illustrated in FIGS. 1 to 4 and FIGS. 6 to 7, head opening 28 wraps around a user's neck. However, it will be understood by a person skilled in the art that head opening 28 is not restricted to an opening around a user's neck only but may include any opening that will allow a user's nose and mouth to connect to breathing apparatuses or the like (for example, an opening around a user's face where an integrated hood is included).

Referring to FIGS. 1 to 4 and FIGS. 7 to 8, entry opening 30 is an opening that is large enough to enable a user to slide their body through to put on drysuit 10. As illustrated in FIGS. 1 to 4 and FIG. 8, entry opening 30 extends from one shoulder to the other shoulder of a user 100 (when worn) and is generally in a semi-circular or curved shape. Referring to FIG. 7, another embodiment of drysuit 10 shows opening 30 extending diagonally across front portion 20. It will be understood by a person skilled in the art that entry opening 30 is not restricted to an opening extending from shoulder to shoulder of user when worn but may be an opening of any other suitable size, shape, and placement.

Referring to FIGS. 1 to 4 and FIGS. 6 to 8, one or more seals 14 are connected to head opening 28 and entry opening 30 for sealing body suit 12 against entry of water. One or more seals 14 may also be connected to any arm openings or leg openings for sealing body suit 12 against entry of water. One or more seals 14 is any watertight seal that may be suitable for use with drysuits. For example, latex seals, rubber seals, silicone seals, etc.

Referring to FIGS. 1 to 4 and FIGS. 7 to 8, fastener 16 is connected to entry opening 30 for fastening entry opening 30 together. As illustrated in FIGS. 1 to 4 and FIGS. 7 to 8, fastener 16 is a waterproof zipper. However, it will be understood by a person skilled in the art that fastener 16 is not restricted to a zipper only but may be any other suitable, waterproof fastener.

Figure 2:
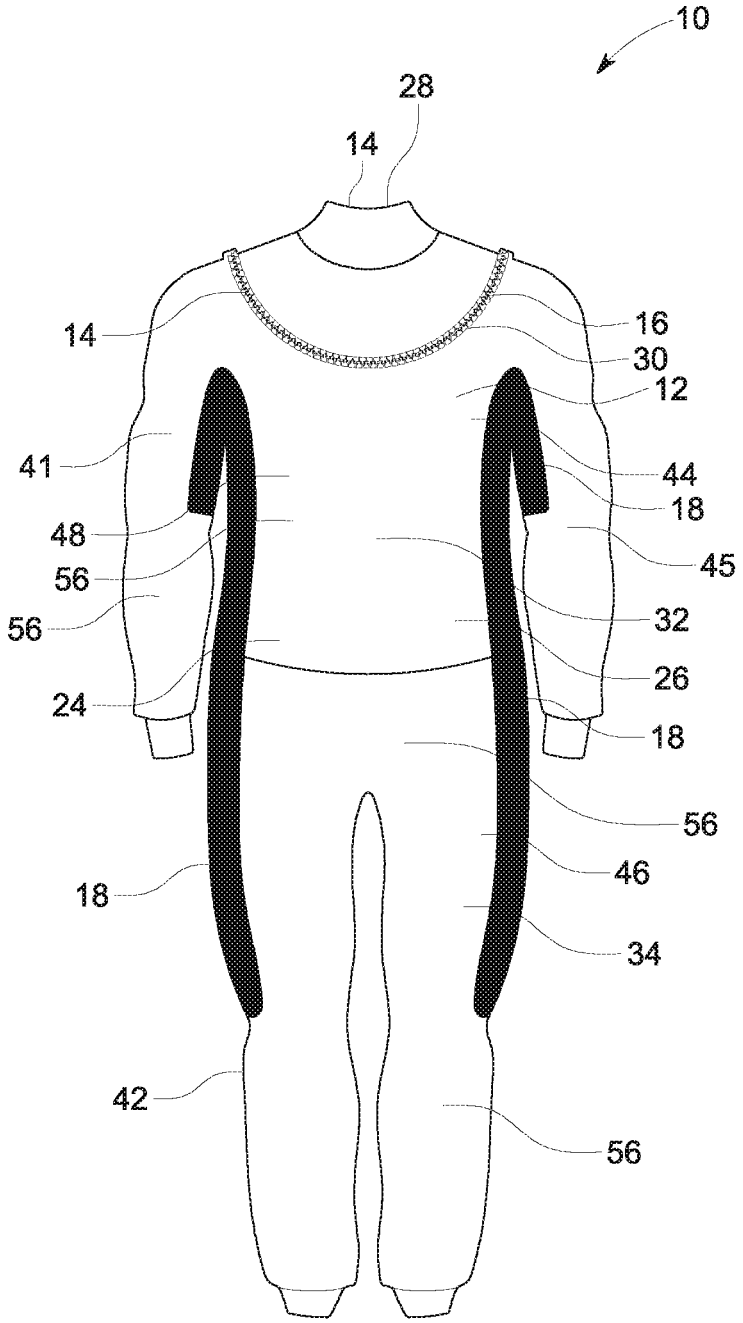
FIG. 2 is a front view of a drysuit according to another embodiment of the present invention.

Referring to FIGS. 1 to 8, one or more elongated panels of elastic material 18 are connected to and overlaying a substantial length of first side portion 24, second side portion 26, front portion 20, or back portion 22 in a longitudinal direction relative to body suit 12, for providing stretch to and compression of body suit 12 in a transverse direction opposite the longitudinal direction. One or more elongated panels of elastic material 18 is elongated in that it has an area with a longer length than width. One or more elongated panels of elastic material 18 may be formed of any material that may provide stretch and compression functions. For example, one or more elongated panels of elastic material 18 may be formed of neoprene, chloroprene, Lycra™, graphene composites, and/or any other suitable elastic material. One or more elongated panels of elastic material 18 is connected to and overlaying a substantial length of one or more of: first side portion 24, second side portion 26, front portion 20, and back portion 22 of body suit 12, on the exterior side of body suit 12 (being the side of body suit 12 that is not in direct contact with a user's body when body suit 12 is worn by a user). One or more elongated panels of elastic material 18 may be connected in any suitable manner to body suit 12 such as by heat sealing, heat welding, stitching, gluing, etc., one or more elongated panels of elastic material 18 to body suit 12. Disposing one or more elongated panels of elastic material 18 in a longitudinal direction and overlaying a substantial length of body suit 12 will enable the whole of or a significant length of body suit 12 to stretch in a transverse direction that is opposite the longitudinal direction. A substantial length of first side portion 24, second side portion 26, front portion 20, or back portion 22 is any length that will enable drysuit 10 to stretch sufficiently to allow a user to don and remove drysuit 10, accommodating for varying body sizes and shapes. For example, and as illustrated in FIG. 1A and FIG. 1B, an elongated panel of elastic material 18 connected to and overlaying a substantial length of first side portion 24 is covering the full length of of first side torso section 40, the full length of first side leg section 42, and the full length of first side arm section 41. A second of elongated panel of elastic material 18 connected to and overlaying a substantial length of second side portion 26 is covering the full length of second side torso section 44, the full length of second side leg section 46, and the full length of second side arm section 45. As illustrated in FIG. 2, an elongated panel of elastic material 18 connected to and overlaying a substantial length of first side portion 24 is covering the full length of first side torso section 40, a partial length of first side leg section 42, and a partial length of first arm section 41. A second of elongated panel of elastic material 18 connected to and overlaying a substantial length of second side portion 26 is covering the full length of second side torso section 44, a partial length of second side leg section 46, and a partial length of second side arm section 45. As illustrated in FIG. 3A, an elongated panel of elastic material 18 connected to and overlaying a substantial length of front portion 20 is covering the full length of front torso section 32 and none of front leg section 34. As illustrated in FIG. 3B, an elongated panel of elastic material 18 connected to and overlaying a substantial length of back portion 22 is covering the full length of back torso section 36 and none of back leg section 38. Enabling such stretch in a transverse direction along a substantial length of body suit 12 enables body suit 12 to expand in a transverse direction to an extent that can accommodate for different body sizes and shapes of users as they don and wear drysuit 10. FIGS. 1 to 8 clearly show at least one non-overlaid portion 56 where the one or more elongated panels of elastic material 18 are not connected to and overlaying the substantial length of the portion of body suit 12. As also clearly shown in FIGS. 1 to 8, the non-overlaid portion 56 forms a greater proportion of body suit 12 than the portion of body suit 12 overlaid with one or more elongated panels of elastic material 18.

As illustrated in FIGS. 1A, 1B and 2, an embodiment of the present invention includes two elongated panels of elastic material 18, with one of the two elongated panels of elastic material 18 connected to first side portion 24, and the other of the two elongated panels of elastic material 18 connected to second side portion 26. As shown in FIGS. 1A and 1B, one or more elongated panels of elastic material 18 is disposed in a longitudinal direction by extending the full length of first side portion 24 and second side portion 26 of body suit 12. However, it will be understood by a person skilled in the art, that one or more elongated panels of elastic material 18 may extend for the full length of body suit 12, for a partial and substantial length of body suit 12, extend for the full or a partial and substantial length of first side torso section 40, extend for the full or a partial and substantial length of second side leg section 46, extend for the full or a partial and substantial length of front torso section 32, etc., or any combination thereof. As shown in FIG. 2, one or more elongated panels of elastic material 18 is disposed in a longitudinal direction and extending a partial and substantial length (from halfway up an arm section to halfway down a section) of first side portion 24 and second side portion 26 of body suit 12. As clearly shown in FIGS. 1A to 8, one or more elongated panels of elastic material 18 overlay less than 66% of a total area of body suit 12.

Referring to FIGS. 1 to 8, one or more panels of elastic material 18 are smaller in area than the first side portion 24, second side portion 26, front portion 20, or back portion 22 that the one or more panels of elastic material 18 are connected to. Inversely, first side portion 24, second side portion 26, front portion 20 or back portion 22 are larger in area than the one or more panels of elastic material 18 it is connected to. Attaching one or more panels of elastic material 18 (that is/are smaller in area relative to the portion of body suit 12 it is being attached to) to first side portion 24, second side portion 26, front portion 20, or back portion 22 (that is/are larger in area relative to the one or more panels of elastic material 18 that is being attached) results in an excess amount of body suit 12 gathering underneath one or more panels of elastic material 18. Accordingly, first side portion 24, second side portion 26, front portion 20 or back portion 22 of body suit 12 forms pleats 54 or are ruched under one or more panels of elastic material 18. As generally shown in FIGS. 4A to 5F, as one or more panels of elastic material 18 stretch and expand with the portion of body suit 12 the one or more panels of elastic material 18 is attached to, first side portion 24, second side portion 26, front portion 20 or back portion 22 of body suit 12 extends and takes on a flat or smooth form. The stretching and compressing of one or more elongated panels of elastic material 18 and the gathering, pleating or ruching of body suit 12, which is formed of a non-stretch, water impermeable material, under one or more panels of elastic material 18, amongst other features as described, will enable body suit 12 and drysuit 10 to expand and contract, despite body suit 12 being formed of non-stretch material.

Figures 4A, 4B:
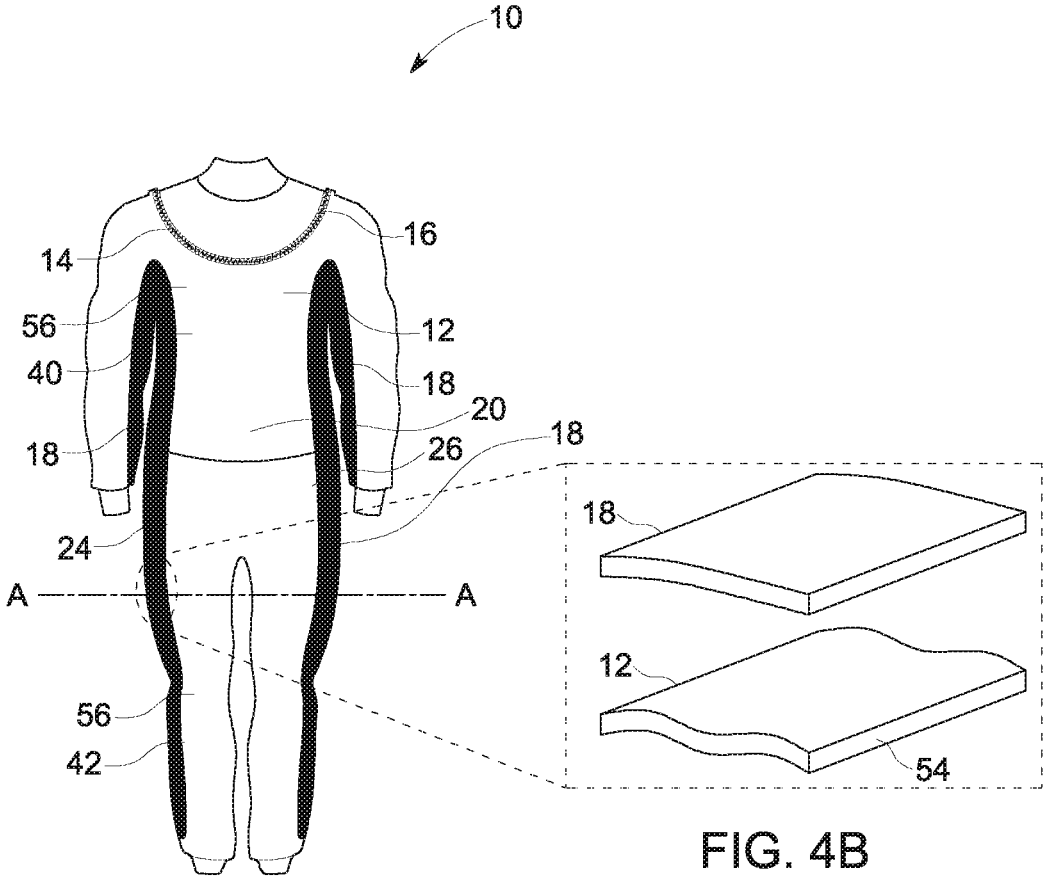
FIG. 4A is a front view of the drysuit of FIG. 1A, showing the drysuit in a generally non-expanded form.
FIG. 4B is an exploded cross section view along lines A-A of a section of the drysuit of FIG. 4A, showing the one elongated panel of elastic material and the first side portion of the body suit in a non-expanded form.
Figures 4C, 4D:
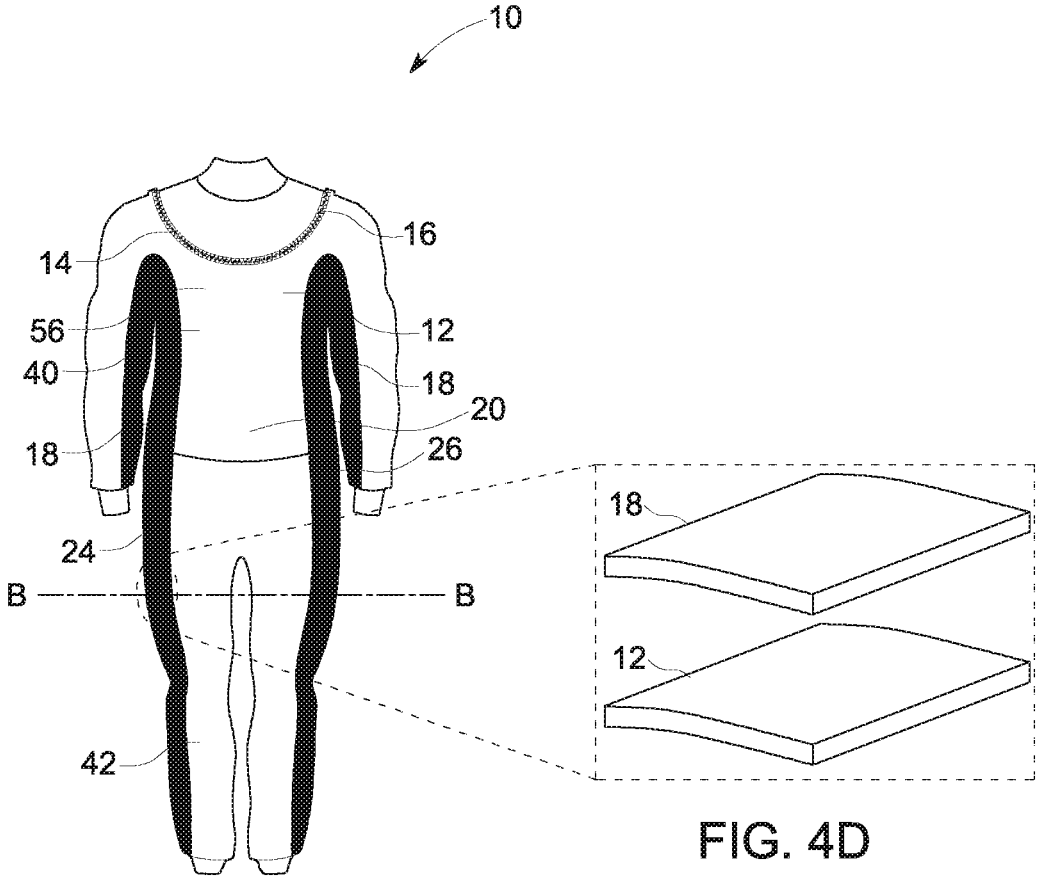
FIG. 4C is a front view of the drysuit of FIG. 1A, showing the drysuit in generally expanded form.
FIG. 4D is an exploded cross section view along lines B-B of a section of the drysuit of FIG. 4C, showing the one elongated panel of elastic material and the first side portion of the body suit, in fully expanded form.

For example, referring to FIGS. 4A and 4B, which show drysuit 10 being worn by a user having a generally smaller figure, one or more elongated panels of elastic material 18 connected to first side portion 24 and second side portion 26 are in a generally non-expanded form substantially throughout one or more elongated panels of elastic material 18. Accordingly, as shown in FIG. 4B, the portions of body suit 12 (i.e., first side portion 24 and second side portion 26) connected to one or more elongated panels of elastic material 18 are gathered and forms pleats 54, while one or more elongated panels of elastic material 18 is in a non-stretched form. Referring to FIGS. 4C and 4D, which show drysuit 10 being worn by a user having a generally larger figure, one or more elongated panels of elastic material 18 connected to first side portion 24 is in a generally expanded form substantially throughout the one or more elongated panels of elastic material 18. Accordingly, as shown in FIG. 4D, the portion of body suit 12 (i.e., first side portion 24) connected to one or more elongated panels of elastic material 18 are extended and takes on a flat or smooth form, while one or more elongated panels of elastic material 18 is in a stretched form. Thus, drysuit 10 can accommodate for users of different body sizes as one or more elongated panels of elastic material 18 expand and compress according to the body size of the user wearing drysuit 10.

Figures 5A, 5B, 5C:
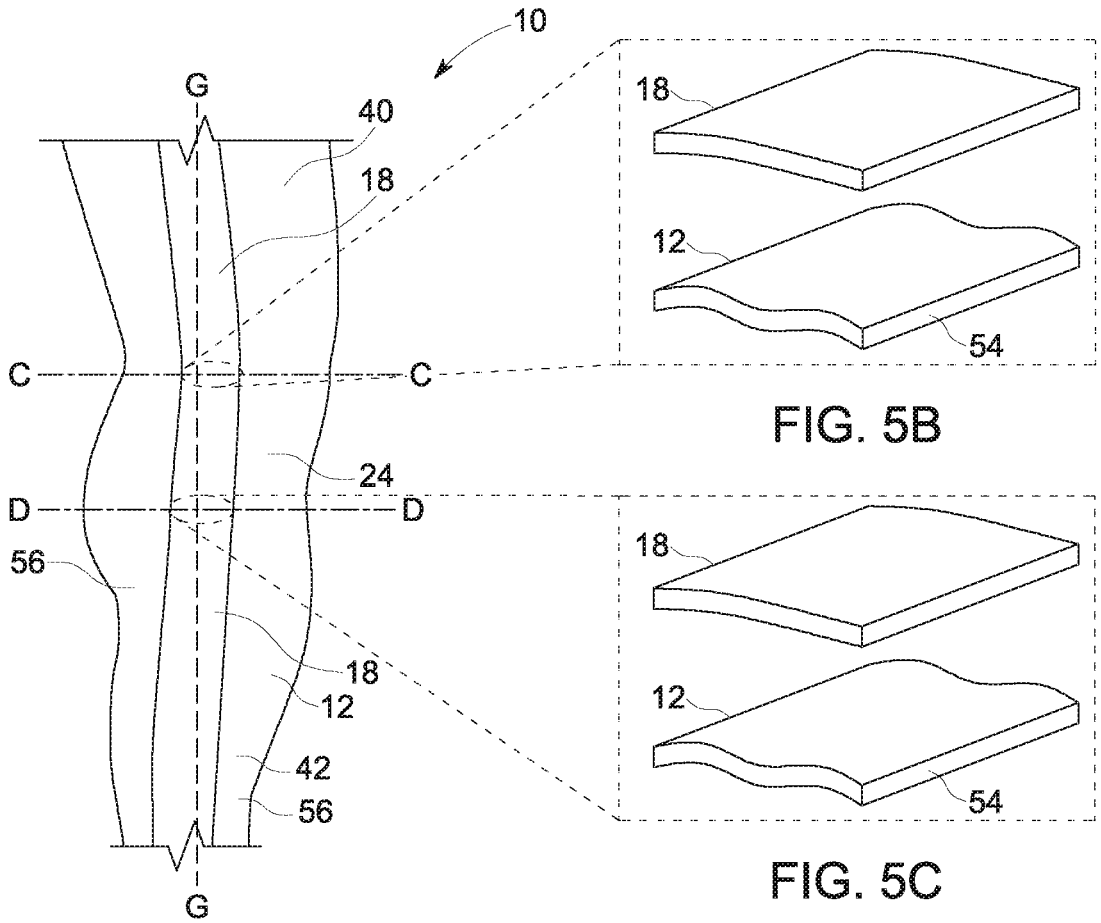
FIG. 5A is a right side view of a section of the drysuit of FIG. 1A, shown being worn by a user with a flatter figure.
FIG. 5B is a cross section view along lines C-C of a section of the drysuit of FIG. 5A, showing the one elongated panel of elastic material and the first side portion of the body suit, in non-expanded form.
FIG. 5C is a cross section view along lines D-D of another section of the drysuit of FIG. 5A, showing the one elongated panel of elastic material and the first side portion of the body suit, in non-expanded form.
Figures 5D, 5E, 5F:
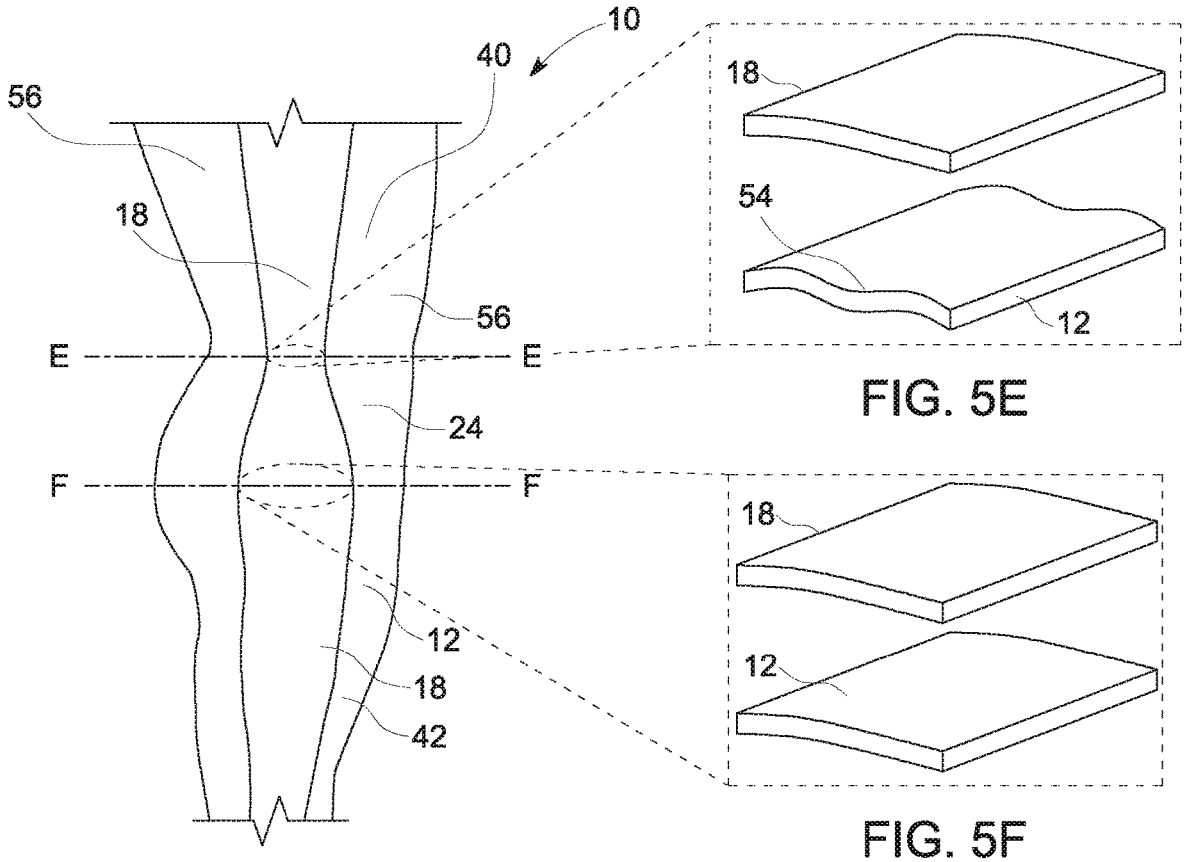
FIG. 5D is a right side view of a section of the drysuit of FIG. 1A, shown being worn by a user with a curvier figure.
FIG. 5E is a cross section view along lines E-E of a section of the drysuit of FIG. 5D, showing the one elongated panel of elastic material and the first side portion of the body suit, in non-expanded form.
FIG. 5F is a cross section view along lines F-F of another section of the drysuit of FIG. 5D, showing the one elongated panel of elastic material and the first side portion of the body suit, in expanded form.
Figure 6:
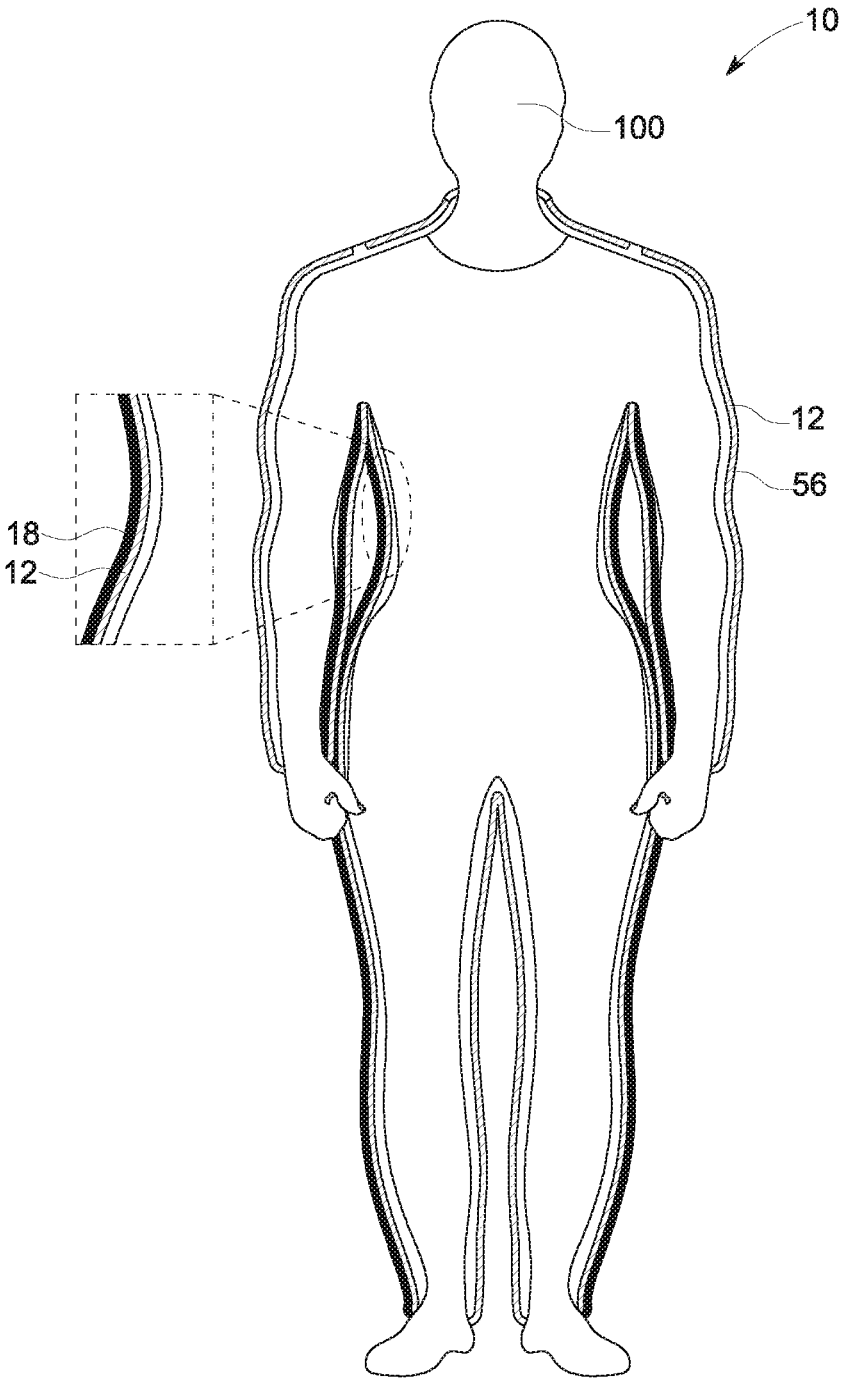
FIG. 6 is a cross section view of the drysuit of FIG. 1A, along lines G-G of FIG. 5A, showing the general air space between the drysuit of FIG. 1A and a user's body.

By way of another example, referring to FIGS. 5A to 5C, which show drysuit 10 being worn by a user having a generally flatter figure, one or more elongated panels of elastic material 18 connected to first side portion 24 is in a generally non-expanded form substantially throughout one or more elongated panels of elastic material 18. Accordingly, as shown in FIGS. 5B and 5C, the portion of body suit 12 (i.e., first side torso section 40 and first side leg section 42) connected to one or more elongated panels of elastic material 18 is gathered and forms pleats 54. Referring to FIGS. 5D to 5F, which show drysuit 10 being worn by a user having a generally curvier figure, one or more elongated panels of elastic material 18 connected to first side portion 24 is in a non-expanded form at one section of the one or more elongated panels of elastic material 18 (i.e., near the waist of the user), and in an expanded form at another section of the one or more elongated panels of elastic material 18 (i.e., near the hips or buttocks of the user). Accordingly, as shown in FIG. 5E, a portion of body suit 12 (i.e., a section of first side portion 24 near the waist of the user) connected to one or more elongated panels of elastic material 18 is gathered and forms pleats 54, while one or more elongated panels of elastic material 18 is in a non-stretched form. As shown in FIG. 5F, another portion of body suit 12 (i.e., a section of first side portion 24 near the hips or buttocks of the user) connected to one or more elongated panels of elastic material 18 is extended and takes on a flat or smooth form, while one or more elongated panels of elastic material 18 is in a stretched form.

Referring to FIGS. 3A and 3B, another embodiment of the present invention is shown. In this embodiment, drysuit 10 includes one or more elongated panels of elastic material 18 being connected to front portion 20 and back portion 22. As illustrated in FIGS. 3A and 3B, one elongated panel of elastic material 18 is connected to front torso section 32, and a second of one elongated panel of elastic material 18 is connected to back torso section 36.

Referring to FIGS. 1 to 8, the combination of: the strategic placement of one or more elongated panels of elastic material 18 in a longitudinal direction relative to body suit 12 (i.e., along the length of body suit 12); the elongation of one or more elongated panels of elastic material 18; the smaller area of one or more elongated panels of elastic material 18 in relation to the area of the portion of body suit 12 said one or more elongated panels of elastic material 18 is/are connected to; and the stretch and compression features of one or more elongated panels of elastic material; is advantageous because it enables drysuit 10 to be water impermeable and able to expand and compress at key sections of drysuit 10. The stretchability of drysuit 10 at key sections of drysuit 10 enables drysuit 10 to accommodate different users'individual body shapes and sizes, whilst providing a better fit in a standardized product. The compressibility of drysuit 10 at key sections of drysuit 10 reduces the volume of air trapped in a donned drysuit 10. Reducing the volume of air trapped in donned drysuit 10 increases safety for the user, by decreasing risks of buoyancy issues when ascending, by decreasing risks of captured air migrating to extremities such as the feet and causing a feet-first ascent, and by decreasing risks of rapid accent injury or death. Lastly, one or more panels of elastic material 18 conceals the excess fabric inherent in a drysuit and provides a streamlined exterior, thereby decreasing drag and potential interference with equipment used by the user.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. A drysuit with stretch and compression panels for use in or around water, the drysuit comprising:

a body suit formed of water impermeable material, the body suit having a front portion, a back portion opposite the front portion, a first side portion disposed between the front portion and the back portion, a second side portion disposed between the front portion and the back portion, the second side portion being opposite the first side portion, a head opening, and an entry opening;

one or more seals connected to the head opening and the entry opening for sealing the body suit against entry of water;

a fastener connected to the entry opening for fastening the entry opening together; and one or more elongated panels of elastic material connected to an exterior side of the body suit, the one or more elongated panels overlaying a substantial length of a portion of the body suit in a longitudinal direction relative to the body suit for providing stretch to and compression of the body suit in a transverse direction opposite the longitudinal direction, the portion of the body suit selected from the group consisting of one or more of: the first side portion, the second side portion, the front portion, or the back portion, thereby defining at least one non-overlaid portion where the one or more elongated panels of elastic material is not connected to and overlaying the substantial length of the portion of the body suit;

wherein the one or more panels of elastic material are smaller in area than the first side portion, the second side portion, the front portion, or the back portion the one or more panels of elastic material are connected to; and wherein the non-overlaid portion forms a greater proportion of the body suit than the portion of body suit overlaid with one or more elongated panels of elastic material.

2. The drysuit of claim 1, wherein:

the one or more panels of elastic material is connected to the first side portion and the second side portion.

3. The drysuit of claim 1, wherein:

the one or more panels of elastic material is connected to the front portion and the back portion.

* * * * *